US006523524B1

(12) United States Patent
Simon

(10) Patent No.: US 6,523,524 B1
(45) Date of Patent: Feb. 25, 2003

(54) RADIAL PISTON PUMP

(75) Inventor: Hans-Juergen Simon, Bad Liebenzell (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/720,117

(22) PCT Filed: Mar. 24, 1999

(86) PCT No.: PCT/DE99/00862

§ 371 (c)(1),
(2), (4) Date: Feb. 27, 2001

(87) PCT Pub. No.: WO00/01948

PCT Pub. Date: Jan. 13, 2000

(30) Foreign Application Priority Data

Jul. 2, 1998 (DE) ..... 198 29 546

(51) Int. Cl.[7] ..... F02M 41/00
(52) U.S. Cl. ..... 123/450; 417/273
(58) Field of Search ..... 123/450, 510; 417/273, 206, 494; 91/491

(56) References Cited

U.S. PATENT DOCUMENTS 4,498,372 A * 2/1985 Pareja ..... 417/534
5,358,383 A * 10/1994 Eisenbacher et al. ..... 417/569
5,382,140 A * 1/1995 Eisenbacher et al. ..... 417/273
5,571,243 A * 11/1996 Arnold et al. ..... 123/198 D
5,979,297 A * 11/1999 Ricco ..... 92/129
6,176,223 B1 * 1/2001 Kuhn et al. ..... 123/495

* cited by examiner

*Primary Examiner*—Henry C. Yuen
*Assistant Examiner*—Mahmoud Gimie
(74) *Attorney, Agent, or Firm*—Ronald E. Greigg

(57) ABSTRACT

A radial piston pump having a drive shaft with camlike protuberances. The pump has a plurality of pistons movable in the radial direction, and one plate is retained on the end of each piston to engage the drive shaft. One or more recesses are disposed in the plate facing the piston, the recesses are engaged by snap hooks on a plate retainer on the piston. In a first variant a blind bore with a circumferential groove recessed out of the middle of the plate facing the piston is engaged by a snap ring retained in a notch on the piston. In a second variant a blind bore is recessed out of the plate facing the piston, and two parallel bores extend transversely to the blind bore, the center lines being tangent to the blind bore, and the bores receive two pins, which engage a notch on the piston.

5 Claims, 4 Drawing Sheets

RADIAL PISTON PUMP

CROSS-REFERENCE TO RELATED APPLICATIONS

This application is a 35 USC 371 application of PCT/DE 99/00862 filed on Mar. 24, 1999.

SPECIFICATION

The invention relates to a radial piston pump for generating high fuel pressure in fuel injection systems of internal combustion engines, in particular in a common rail injection system, having a drive shaft which is supported in a pump housing and is embodied eccentrically or has camlike protuberances in the circumferential direction, and having preferably a plurality of pistons, disposed radially in a respective element bore relative to the drive shaft, which are movable back and forth in the radial direction by rotation of the drive shaft in the applicable element bore, and one plate is retained on each of the ends toward the drive shaft of the pistons.

One such radial piston pump is known for instance from German Patent Disclosure DE 42 16 877. In the known radial piston pump, the plate is retained on the associated piston by a clamp device in the form of a plate disk with inward-recurved clamp arms that engage the plate around its edge. When the clamp devices are in storage, it repeatedly happens that the inward-recurved clamp arms of different clamp devices catch on one another. Separating the individual clamp devices again takes time and slows down the assembly of the radial piston pump.

The object of the invention is therefore to furnish a radial piston pump that can be assembled simply and quickly. In particular, the individual clamp devices are to be prevented from catching on one another during storage.

In a radial piston pump for generating high fuel pressure in fuel injection systems of internal combustion engines, in particular in a common rail injection system, having a drive shaft which is supported in a pump housing and is embodied eccentrically or has camlike protuberances in the circumferential direction, and having preferably a plurality of pistons, disposed radially in a respective element bore relative to the drive shaft, which are movable back and forth in the radial direction by rotation of the drive shaft in the applicable element bore, and one plate is retained on each of the ends toward the drive shaft of the pistons, this object is attained in that in the surface facing toward the piston of the plate, one or more recesses are disposed, which are engaged in the assembled state by snap hooks that are embodied on a plate retainer which is mounted on the associated piston. Besides simple, fast assembly, the snap hooks offer the advantage that they do not warp as much upon assembly as the clamp arms known from the prior art. This reduces the load on the material during assembly and leads to a longer service life of the radial piston pump.

In a first variant of the invention, the aforementioned object is attained in that in the surface of the plate facing toward the piston, a blind bore with a circumferential groove is recessed out of the middle, which groove is engaged by a snap ring that is retained in a notch on the piston. This variant offers the advantage not only of faster assembly but also that it makes do with fewer parts than the known version. This reduces the production costs of the radial piston pump.

In a second variant of the invention, the aforementioned object is attained in that in the surface of the plate facing toward the piston, a blind bore and two parallel bores are recessed out in the middle, which parallel bores extend transversely to the blind bore in such a way that the center lines of the bores are tangent to the jacket face of blind bore, and the bores serve to receive two pins, which in the inserted state engage a notch that is made on the piston. With this second variant, the same advantages as with the first variant are attained.

A special feature of the second variant of the invention is characterized in that the two pins are joined by a crosspiece to form a clamp. This feature has the advantage that the pins are automatically fixed axially when the crosspiece comes to a stop against the plate.

A further feature of the second variant of the invention is characterized in that the crosspiece, in the inserted state of the clamp, is secured by a protrusion that is formed on the plate. As a result, it is advantageously assured that the pins during operation will not slip out of the bores.

Further advantages, characteristics and details of the invention will become apparent from the ensuing description, in which several exemplary embodiments of the invention are described in detail in conjunction with the drawings. The characteristics recited in the claims and in the description can each be essential to the invention individually or in arbitrary combination.

DETAILED DESCRIPTION OF THE INVENTION

Figure 1:
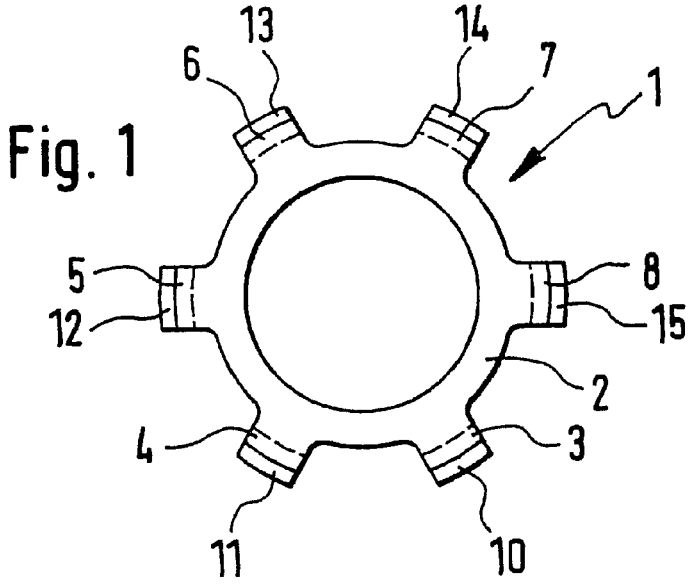
FIG. 1 shows a plan view of a plate retainer in a first variant of the present invention.

The plate retainer identified overall by reference numeral 1 in FIG. 1 is formed by a base body 2, which takes the form of a ring of rectangular cross section. Six arms 3, 4, 5, 6, 7 and 8 extend radially from the base body 2.

Figure 2:
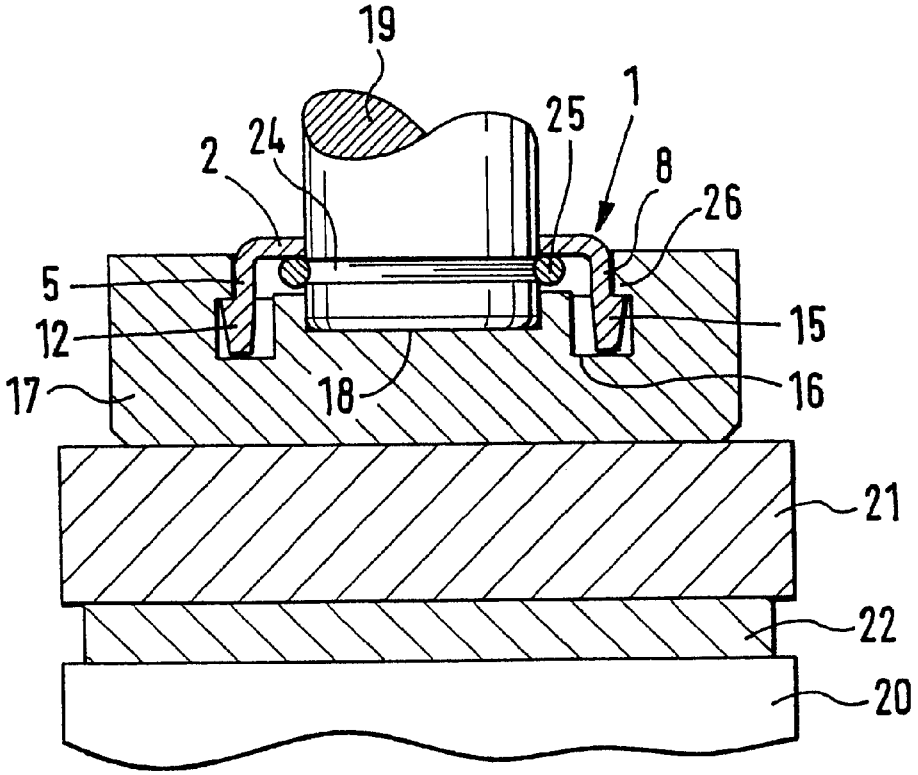
FIG. 2 shows a fragmentary section through a radial piston pump in the longitudinal direction of a piston, with the plate retainer of FIG. 1.

As seen from the sectional view in FIG. 2, the arms 3–8 are bent at an angle of 90° from the base body 2. The ends of the arms 3–8 are embodied as snap hooks 10–15.

The snap hooks 10–15 engage a recess 16 which is embodied in a plate 17. In the middle, the plate 17 has a blind bore 18, in which a piston 19 is received.

The piston 19 is part of a radial piston pump, braced on the inside, of the kind used in particular in a common rail injection system for supplying fuel to diesel engines. The term "common rail" means the same as "common line". In contrast to conventional high-pressure injection systems, in which the fuel is fed to the individual combustion chambers via separate lines, in common rail injection systems the injection nozzles are supplied from a common line.

The radial piston pump shown only in part in FIG. 2 includes a drive shaft, supported in a pump housing, with an eccentrically embodied shaft portion 20. A ring 21 is disposed on the eccentric shaft portion 20, relative to which ring the shaft portion 20 is supported rotatably with the aid of a slide bearing 22. The ring 21 includes three flat faces, offset from one another by 120°, against each of which one piston is braced. The pistons, preferably three of them, are each received, in a manner capable of reciprocation in the radial direction, in a respective element bore of the drive shaft, and each piston defines a cylindrical chamber.

The radial piston pump shown only in part in FIG. 2 serves to subject fuel, which is furnished from a tank by a prefeed pump, to high pressure. The fuel subjected to high pressure is then pumped into the aforementioned common line. In the supply stroke, the pistons 19 are moved outward, away from the axis of the drive shaft, as a consequence of the eccentric motion of the eccentric shaft portion 20, which is transmitted to the pistons 19 via the ring 21. In the intake stroke, the pistons 19 move radially toward the axis of the drive shaft, in order to aspirate fuel into the cylinder chambers. The intake stroke motion of the pistons 19 is achieved by springs, not shown, that are prestressed against the plates 17.

The plate retainer 1 keeps the plate 17 in contact with the piston 19, and vice versa. On the end of the piston 19 toward the plate 17, a notch 24 is provided, in which a snap ring 25 is disposed. The snap ring 25 forms a stop for the annular base body 2 of the plate retainer 1. In this way, the plate retainer 1 is prevented from slipping downward off the end of the piston 19.

The recess 16 in the plate 17 takes the form of a ring of rectangular cross section and is open toward the top. On the side of the recess 16 that is open toward the piston 19, an encompassing shoulder 26 protrudes into the recess 16 and forms an abutment for the snap hooks 10–15.

On the inside, in the region of the blind bore 18, the plate 17 has a lesser thickness than outside, in the region of the shoulder 26. In this way, space for receiving the snap ring 25 is created. As a consequence, the base body 2 of the plate retainer 1 protrudes only slightly past the surface of the plate 17.

Figure 3:
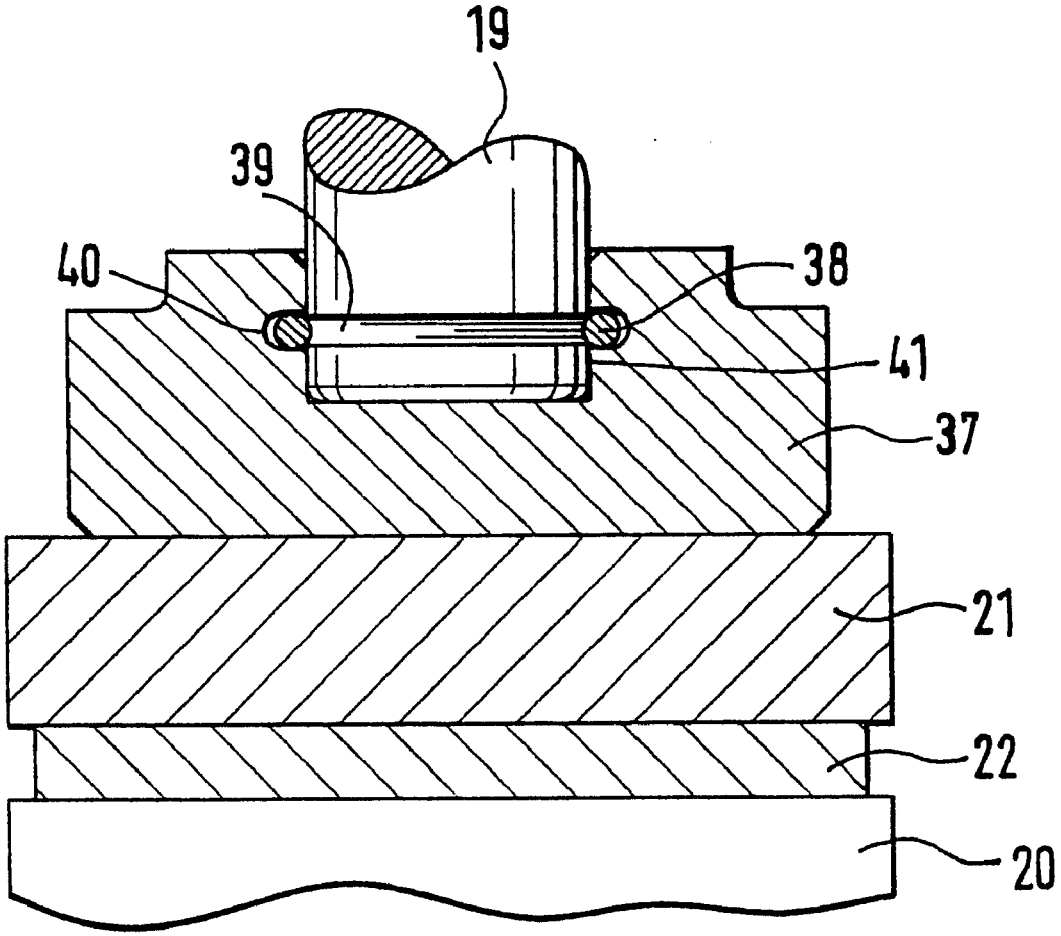
FIG. 3 shows a fragmentary section through a radial piston pump in the longitudinal direction of a piston, with the plate retainer in a second variant of the present invention.
Figure 4:
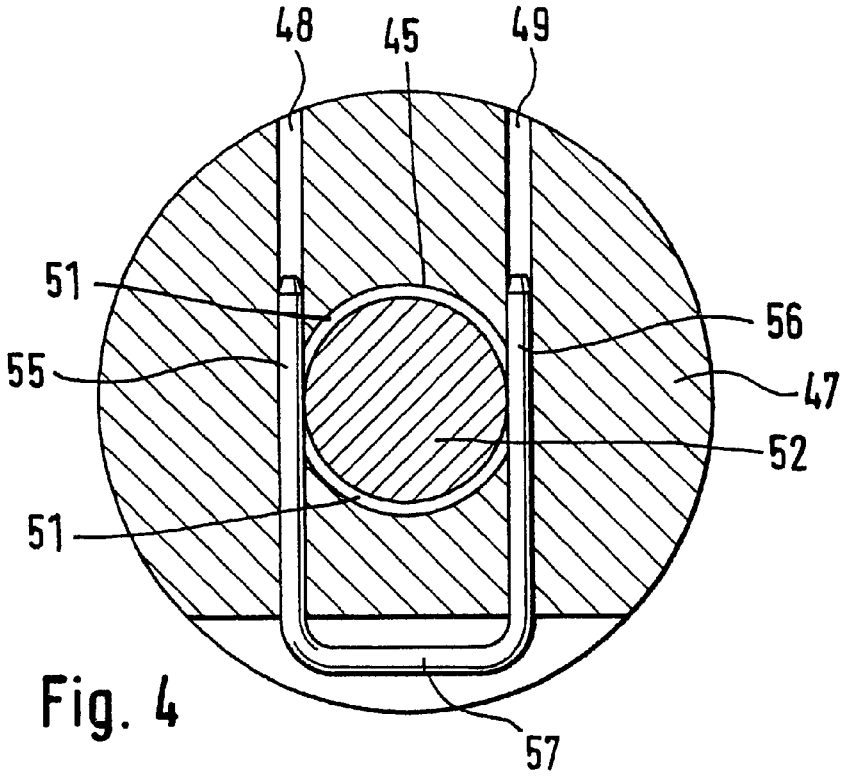
FIG. 4 shows a fragmentary section through a radial piston pump in the longitudinal direction of a piston, with the plate retainer in a third variant of the present invention.
Figure 5:
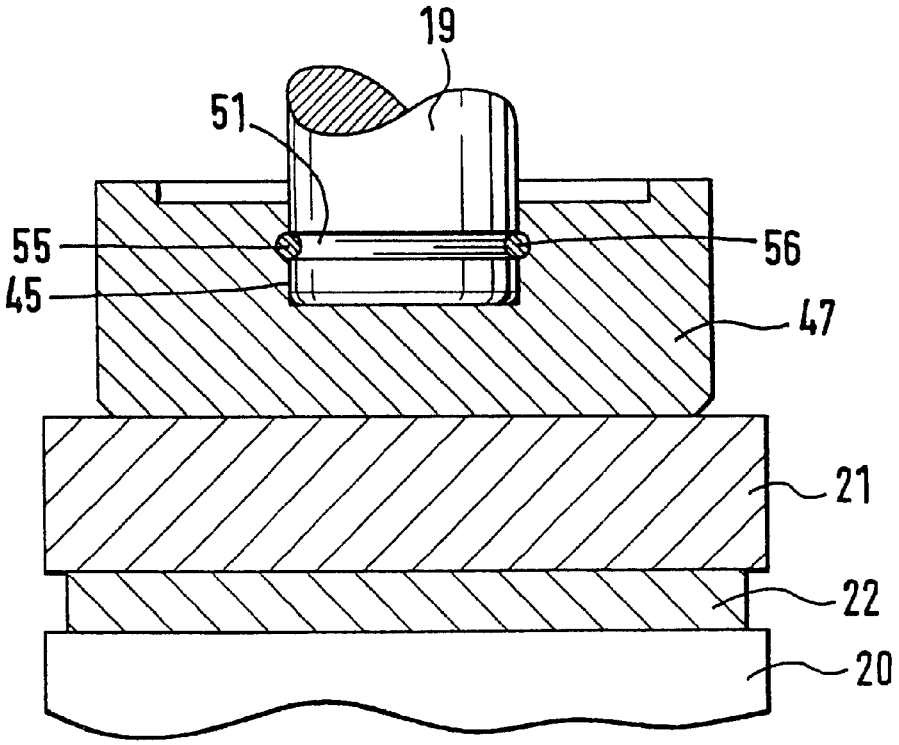
FIG. 5 shows a fragmentary section through a radial piston pump in the longitudinal direction of the piston.

In a first variation of the invention, as shown in FIG. 3, the basic design of the pump is primarily the same as shown in FIGS. 1 and 2. For the sake of simplicity, the same reference numerals are used for the same elements. The eccentric shaft portion 20 of the drive shaft of a radial piston pump is supported rotatably with the aid of a slide bearing 22 in a pump housing, not shown. The eccentric motion of the drive shaft is transmitted to a plate 37, mounted on the piston 19, via a ring or polygon 21.

In this variant of the invention, however, only a snap ring 38 is used as the plate retainer. The snap ring 38 is in contact with a notch 39, which is provided on the end of the piston toward the plate 37. Adjacent to the notch 39 of the piston 19, a circumferential groove 40 is embodied in the plate 37. The depth of the circumferential groove 40 is somewhat greater than the diameter of the cross section of the snap ring 38. This makes it simpler to mount the plate 37 on the piston 19.

The assembly can proceed as follows. First, the snap ring 38 is placed in the circumferential groove 40 of the plate 37. Next, in a manner like a fast-action coupling, the piston 19 is inserted into the blind bore 41 that is recessed out of the plate 37. Upon insertion of the piston 19 into the blind bore 41, the snap ring 38 is first pressed into the circumferential groove 40 and then snaps into the notch 39.

In the variant of the invention shown in FIGS. 4–7, a blind bore 45 for receiving a piston 19 is recessed out of a plate 47. As seen from FIG. 4, two bores 48, 49 extend in the plate 47, perpendicular to the blind bore 45. The center lines of the bores 48, 49 have a spacing from one another equivalent to the diameter of the piston 19. In the assembled state, that is, when the piston 19 is in place with its end in the plate 47, the bores 48, 49 partly coincide with a notch 51 that is provided on the piston 19.

To secure the plate 47 to the piston 19, two pins 55, 56 are received in the bores 48, 49. The pins 55, 56 protrude from two sides into the notch 51 of the piston 19. The two pins 55, 56 are joined to one another by a crosspiece 57.

Figure 6:
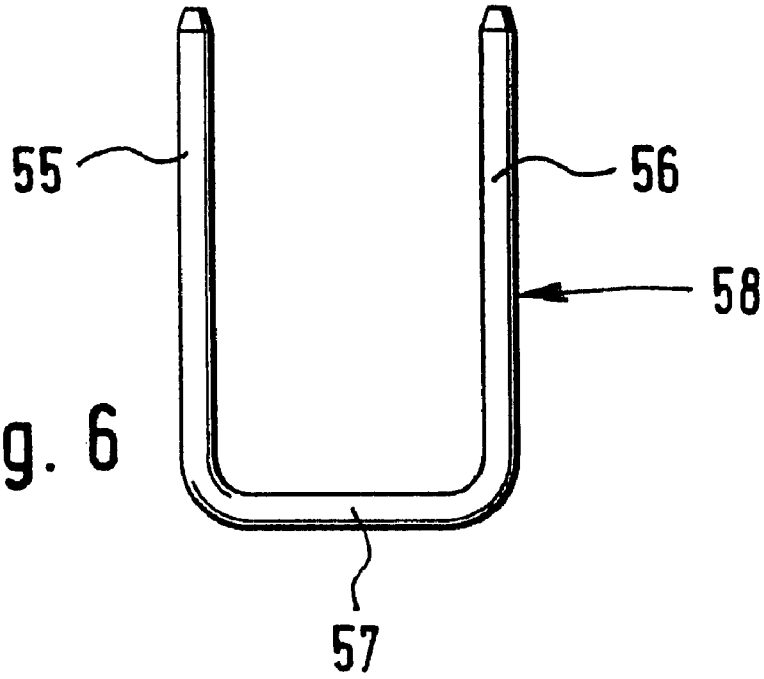
FIG. 6 shows a plan view of the plate retainer used in FIGS. 4 and 5.

As best seen in the separate view in FIG. 6, the pins 55, 56 and the crosspiece 57 form a clamp, identified overall by reference numeral 58.

Figure 7:
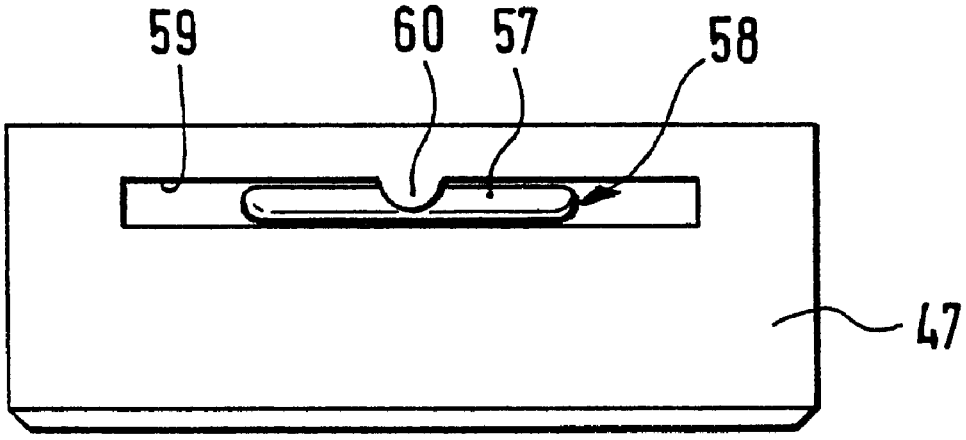
FIG. 7 shows a front view of the plate retainer, shown in FIGS. 4–6, in the installed state.

In FIG. 7, the clamp 58 is shown in the installed state. In the view shown, it can be seen that there is a recess 59 in the plate 47, for receiving the clamp 58. A protrusion 60 formed onto the plate 47 serves as a securing means that fixes the crosspiece 57 in its position in the installed state.

The foregoing relates to preferred exemplary embodiments of the invention, it being understood that other embodiments and variants thereof are possible within the spirit and scope of the invention, the latter being defined by the appended claims.

What is claimed is:

1. A radial piston pump for generating high fuel pressure in fuel injection systems of internal combustion engines, having a drive shaft which is supported in a pump housing and is eccentric in the circumferential direction, and having one or more pistons (19) disposed radially relative to the drive shaft, each piston having one end which is driven by the eccentric shaft, which pistons are movable back and forth in the radial direction by rotation of the drive shaft, and a plate (17) is retained on said one end of each of the pistons (19), wherein a plate retainer (1) having snap hooks (10–15) is mounted on the end of each of the pistons (19), and in the surface of the plate (17) which faces toward the piston (19), one or more recesses (16) are disposed, which recesses (16) are engaged by the snap hooks (10–15) when the pistons (1) are assembled to the plates (17).

2. A radial piston pump for generating high fuel pressure in fuel injection systems of internal combustion engines, having a drive shaft which is supported in a pump housing and is eccentric in the circumferential direction, and having one or more pistons (19) disposed radially relative to the drive shaft, each piston having one end which is driven by the eccentric shaft, which pistons are movable back and forth in the radial direction by rotation of the drive shaft, and a plate (37) is retained on said one end of each of the pistons (19), wherein each piston has a notch (39), and in the surface of each plate (37) which faces toward the piston (19), there is a blind bore (41) with a circumferential groove (40) recessed out of the middle, which groove is engaged by a snap ring (38) that is retained in the notch (39) on the piston (19) when the piston is assembled to the plate (37).

3. A radial piston pump for generating high fuel pressure in fuel injection systems of internal combustion engines, having a drive shaft which is supported in a pump housing and is eccentric in the circumferential direction, and having one or more pistons (19) disposed radially relative to the drive shaft, each piston having one end which is driven by the eccentric shaft, which pistons are movable back and forth in the radial direction by rotation of the drive shaft, and a plate (47) is retained on said one end of each of the pistons (19), wherein each piston has a notch (51), and, in the surface of each plate (47) which faces toward the piston (19), a blind bore (45) is recessed out, and two parallel bores (48, 49) extend through the plate (47) transversely to the blind bore (45) in such a way that the center lines of the parallel bores (48, 49) are tangent to the blind bore (45), and the parallel bores (48, 49) serve to receive two pins (55, 56), which in their inserted state engage the notch (51) of the piston (19).

4. The radial piston pump of claim 3, wherein the two pins (55, 56) are joined by a crosspiece (57) to form a clamp (58).

5. The radial piston pump of claim 4, wherein the plate (47) has a protrusion (60), and the crosspiece (57) engages the protrusion (60) when the clamp (58) is inserted.

* * * * *